US006199721B1

(12) United States Patent
Dunham et al.

(10) Patent No.: US 6,199,721 B1
(45) Date of Patent: Mar. 13, 2001

(54) METHOD AND SYSTEM FOR DISPENSING AN IRREGULARLY SHAPED ARTICLE FOR RETAIL SALE

(75) Inventors: David A. Dunham, Baltimore; Kirsten M. Smith, Towson, both of MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/257,614

(22) Filed: Feb. 25, 1999

(51) Int. Cl.[7] ..... B65G 59/00
(52) U.S. Cl. ..... 221/67; 206/467
(58) Field of Search ..... 221/67, 92, 123, 221/131, 174; 206/461, 467

(56) References Cited

U.S. PATENT DOCUMENTS

| | | | |
|---|---|---|---|
| 2,715,458 | 8/1955 | Polglase | 206/65 |
| 3,899,100 | 8/1975 | Rigaud | 220/229 |
| 4,417,613 | 11/1983 | Ryan et al. | 150/52 R |
| 4,848,577 * | 7/1989 | Hoffman et al. | 206/467 |

FOREIGN PATENT DOCUMENTS

| | | |
|---|---|---|
| 26 48 539 | 5/1978 | (DE) . |
| 38 28 411 | 2/1980 | (DE) . |
| 33 11 748 | 10/1984 | (DE) . |
| 36 35 959 | 5/1988 | (DE) . |
| 91 15 020 U | 12/1991 | (DE) . |
| 41 09 275 | 9/1992 | (DE) . |
| 9320502 U * | 1/1995 | (DE) . |
| 93 20 502 U | 1/1995 | (DE) . |
| 87 03 713 U | 6/1998 | (DE) . |
| 22374 | 10/1913 | (GB) . |
| WO 90/11948 | 10/1990 | (WO) . |

* cited by examiner

*Primary Examiner*—Kenneth W. Noland
(74) *Attorney, Agent, or Firm*—Harness, Dickey & Pierce, P.L.C.

(57) ABSTRACT

A system for dispensing an irregularly shaped article for retail sale includes a package assembly and a dispensing assembly. The package assembly includes an inner packaging portion and an outer packaging portion. The outer packaging portion defines a cylindrical cavity. The inner packaging portion is disposed within the cylindrical cavity. The inner packaging portion defines a cavity for receiving the irregularly shaped article. The inner packaging portion preferably includes at least one cylindrical portion matingly received within the outer packaging portion.

17 Claims, 4 Drawing Sheets

METHOD AND SYSTEM FOR DISPENSING AN IRREGULARLY SHAPED ARTICLE FOR RETAIL SALE

BACKGROUND OF THE INVENTION

1. Technical Field

The present invention generally pertains to retail merchandising. More particularly, the present invention pertains to a method and system for dispensing an irregularly shaped article for retail sale. More specifically, but without restriction to the particular embodiment and/or use which is shown and described for purposes of illustration, the present invention relates to a method and system for dispensing an irregularly shaped article for retail sale which incorporates an inner packaging portion defining an inner chamber for receiving the irregularly shaped article and an outer packaging portion having a cylindrical outer diameter.

2. Discussion

Shipment of products and the subsequent display of the products for retail sale is complicated where the products are irregularly shaped. Where the product is generally rectangular in shape, it can be packaged within a generally rectangular box. Such rectangular boxes can be easily stacked for shipment, as well as on shelving for retail display.

Various techniques have been heretofore employed for the shipping and display of irregularly shaped products. For example, it is known to package irregularly shaped products such as toys and other merchandise within blister packs formed by a sheet of clear plastic molded to conform generally to a face of the product and marginally bonded to a cardboard backing. The cardboard backing can be easily suspended from a peg for retail display. However, a blister pack has a contoured formation largely determined by the article housed therein. It is not box-like and lacks the structural strength and handling characteristics of rectangular and cylindrical packages. Because of their contoured shape, blister packs do not readily lend themselves to stacking or dispensing.

Another known technique for packaging an irregularly shaped article for shipment and subsequent retail sale is shown in U.S. Pat. No. 4,848,577. The '577 patent is specifically directed to a double-faced blister pack and frame assembly for packaging and displaying an article of merchandise. The article is sandwiched between a pair of transparent plastic sheets whose general regions are molded to generally conform to the opposite faces of the article. The four margins of the sheets each define a flange. The frame is formed of a cardboard strip that is die cut and folded so as to create a chain of four interhinged branches.

While techniques heretofore employed for packaging irregularly shaped articles have proven to reduce difficulties in stacking the products, they are all attendant with drawbacks. For example, products including such known packaging often consume significant shelf space and require frequent restocking and/or product organization on the display shelves. A need remains in the art for providing packaging for an irregularly shaped article which overcomes these disadvantages.

SUMMARY OF THE INVENTION

It is a general object of the present invention to provide an improved method and system for dispensing an irregularly shaped article for retail sale.

It is another object of the present invention to provide a system for dispensing an irregularly shaped article for retail sale which reduces product restocking.

It is another object of the present invention to provide a system for dispensing an irregularly shaped article for retail sale which incorporates a package assembly having a generally cylindrical exterior which may be easily dispensed.

It is another objection of the present invention to provide a method including the steps of packaging each of a plurality of irregularly shaped articles within a package assembly and loading the package assemblies into a continuous stocking path for individual dispensing.

It is a more particular object of the present invention to provide a package assembly for an irregularly shaped article having an inner packaging portion defining a cavity for receiving the irregularly shaped article and a cylindrical outer packaging portion defining a channel for receiving the inner packaging portion.

In one form, the present invention provides a package assembly for an irregularly spaced article. The package assembly includes an inner packaging portion and an outer packaging portion. The outer packaging portion defines a cylindrical cavity. The inner packaging portion is disposed within the cylindrical cavity. The inner packaging portion defines a cavity for receiving the irregularly shaped article. The inner packaging portion includes at least one cylindrical portion matingly received within the outer packaging portion.

In a more particular form, the present invention provides a system for dispensing an irregularly shaped article for retail sale. The system includes a plurality of package assemblies and a dispensing assembly. The dispensing assembly is operative for dispensing the plurality of package assemblies. Each package assembly of the plurality of package assemblies includes an outer packaging portion and an inner packaging portion. The outer packaging portion defines a generally cylindrical cavity. The inner packaging portion is disposed within the generally cylindrical cavity and defines a cavity for receiving the irregularly shaped article. The inner packaging portion includes at least one generally cylindrical portion matingly received within the outer packaging portion.

In another form, the present invention provides a method for dispensing a plurality of irregularly shaped articles for retail sale. The method includes the general step of providing a corresponding plurality of package assemblies each including an inner packaging portion defining a cavity and an outer packaging portion having a cylindrical member defining a generally cylindrical cavity. The method additionally includes the step of matingly receiving each of the irregularly shaped articles within the cavity of the inner packaging portion of a corresponding one of the plurality of package assemblies. The method further includes the general step of disposing each inner packaging portion of the plurality of package assemblies in a corresponding outer packaging portion to create a plurality of retail units each having a longitudinal axis and a circular cross-section in a plane perpendicular to the longitudinal axis.

Additional benefits and advantages of the present invention will become apparent to those skilled in the art to which this invention relates from a reading of the subsequent description of the preferred embodiment and the appended claims, taken in conjunction with the accompanying drawings.

DETAILED DESCRIPTION OF THE PREFERRED EMBODIMENT

Figure 1:
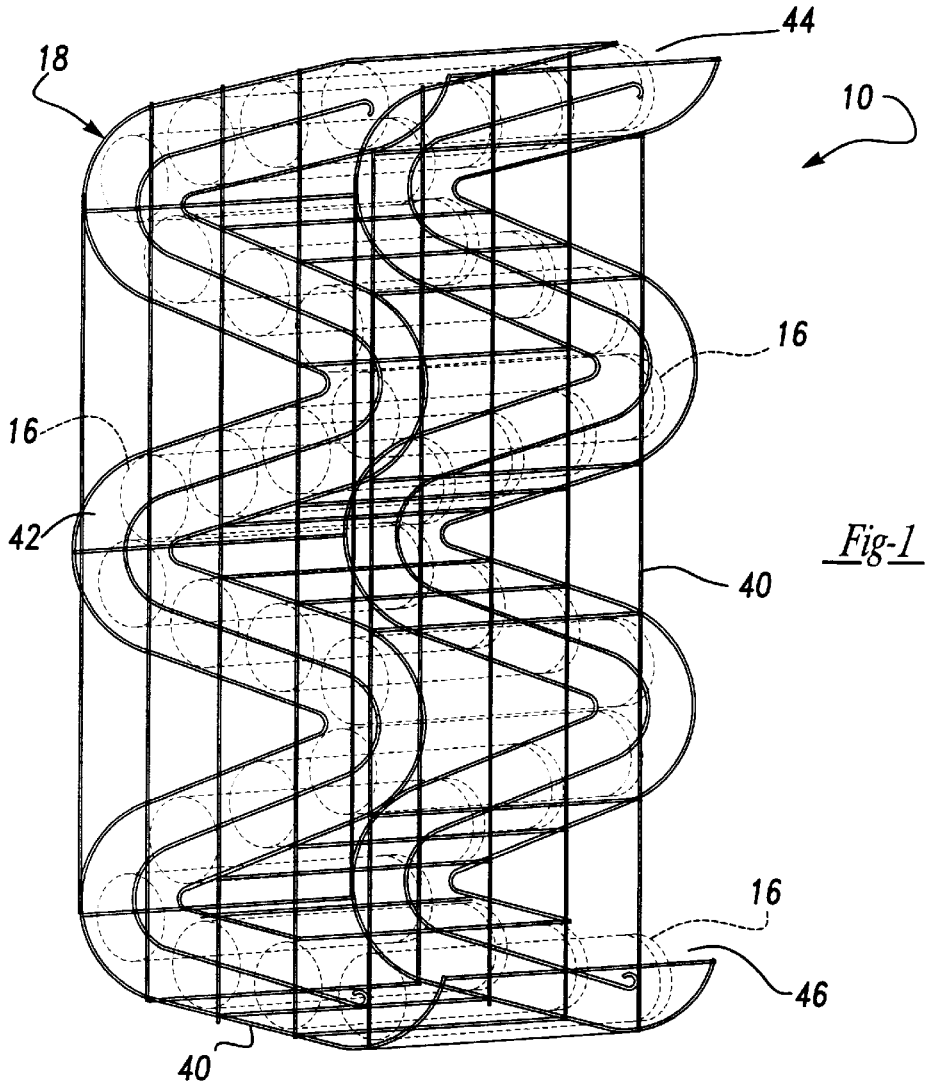
FIG. 1 is a perspective view of a system for dispensing an irregularly shaped article for retail sale constructed in accordance with the teachings of a preferred embodiment of the present invention.
Figure 3:
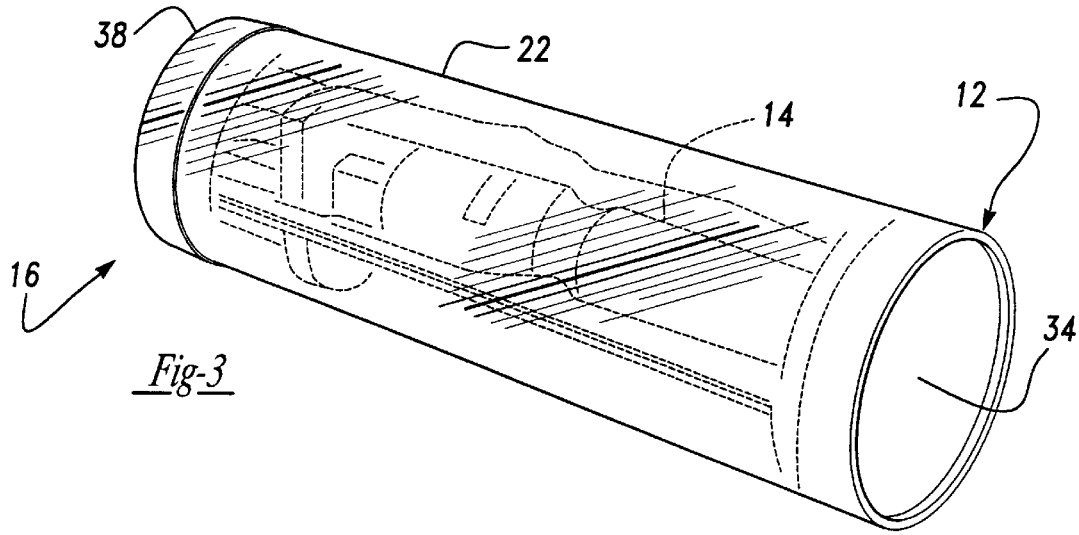
FIG. 3 is an enlarged perspective view of one of the retail units shown in FIG. 1.

With initial reference to FIG. 1, a system for dispensing an irregularly shaped article for retail sale constructed in accordance with the teachings of a preferred embodiment of the present invention is generally identified at reference numeral 10. The present invention is particularly directed to a package assembly 12 for an irregularly shaped article 14. When the irregularly shaped article 14 is placed within the package assembly 12, a retail unit 16 is created. The present invention is also particularly directed to a dispensing assembly 18 for dispensing a plurality of the retail units 16.

In the exemplary application illustrated throughout the drawings, the irregularly shaped article 14 includes a cordless power screwdriver 20 and a battery recharger 21. However, package assembly 12 may be modified for other types of irregularly shaped articles. As will become apparent below, the package assembly 12 of the present invention encapsulates the irregularly shaped article 14 and provides a configuration which is more easily shipped and dispensed for retail sale.

A. The Package Assembly 12

Referring to FIGS. 3–6, the package assembly 12 of the present invention will be further described. The package assembly 12 is illustrated to generally include an inner packaging portion 20 and an outer packaging portion 22. The inner packaging portion 20 preferably includes first and second halves 24 and 26. The first and second halves 24 and 26 cooperate to define a cavity for receiving the irregularly shaped article 14. In the preferred embodiment, the first and second halves 24 and 26 of the inner packaging portion 20 are molded of plastic to each include an inner surface 28 generally configured to cooperatively receive the irregularly shaped article 14. Portions of the irregularly shaped article 14 are matingly received by the inner sides 28 of the first and second halves 24 and 26 to securely retain the irregularly shaped article within the cavity defined by the first and second halves 24 and 26.

The first and second halves 24 and 26 of the inner packaging portion 20 may be secured to one another after the irregularly shaped article 14 is placed therebetween in any of a number of manners well known in the art. For example, the first and second halves 24 and 26 may include cooperating portions (not shown) which may be releasably snapped together. Alternatively, the first or second halves 24 and 26 may be staked or adhesively held together. In certain applications, it may be desirable to interconnect one longitudinal edge of each of the first and second halves 24 and 26 through a living hinge. In this manner, the first half 24 would be permitted to pivot with respect to the second half 26.

In the preferred embodiment, at least a portion of the assembled inner packaging portion 20 includes a circular outer diameter in a plane perpendicular to the longitudinal axis of the inner packaging portion 20. In the embodiment illustrated, the inner packaging portion 20 includes a first end 30 having a circular outer diameter. In addition, the inner packaging portion 20 includes a second end 32 having a circular outer diameter.

The outer packaging portion 22 of the package assembly 16 of the present invention is hollow and cylindrical. As a result, the outer packaging portion 22 defines a generally cylindrical cavity 33. A first end 34 of the outer packaging portion 22 is closed. A second end 36 of the outer packaging portion 22 is open to receive the inner packaging portion 20 containing the irregularly shaped article 14. In the exemplary embodiment, the outer packaging portion 22 has an inner diameter sized to matingly receive the first and second ends 30 and 32 of the inner packaging portion 20. As with the inner packaging portion 20, the outer packaging portion 22 is preferably constructed of plastic. In one application, an adhesive pad (not shown) is employed to secure the inner packaging portion 24 to the outer packaging portion 22 so as to thereby prevent relative rotation.

The package assembly 12 of the present invention further includes a cap 38. The cap 38 is constructed of plastic and is a hollow cylinder with a closed end and an opened end. A recess defined by the cap 38 has an inner diameter slightly larger than the outer diameter of the outer packaging portion 22 so that the second end 36 of the outer packaging portion 22 may be received therein. Adhesive or the like (e.g., staking or RF sealing) is employed for preventing inadvertent removal of the cap 32 from the outer packaging portion 22.

B. The Dispensing Assembly 18

Figure 2:
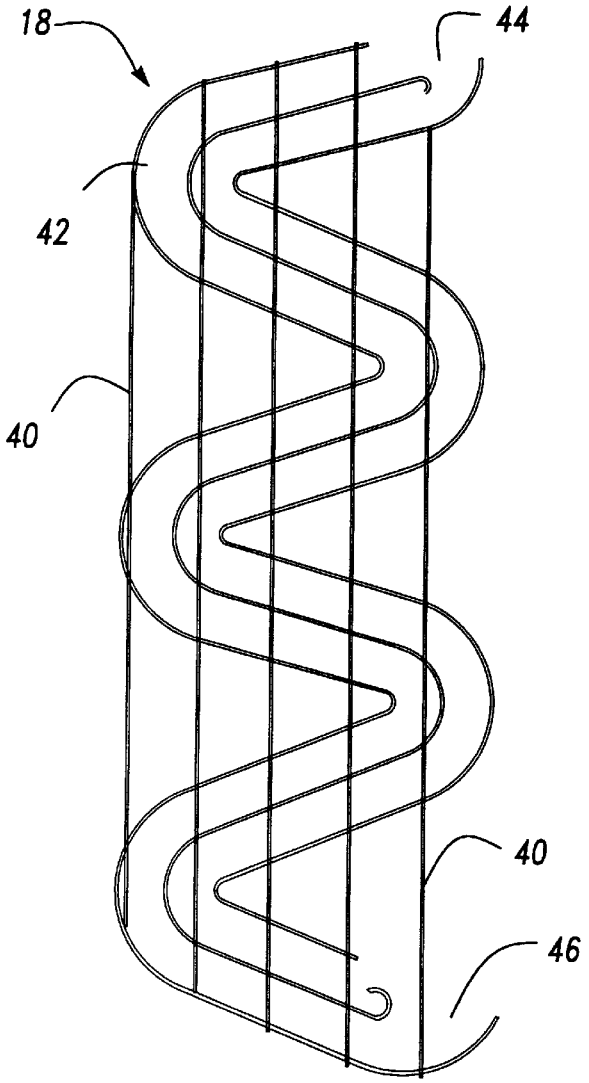
FIG. 2 is a side view of a dispensing assembly of the system for dispensing an irregularly shaped article for retail sale of FIG. 1.
Figure 5:
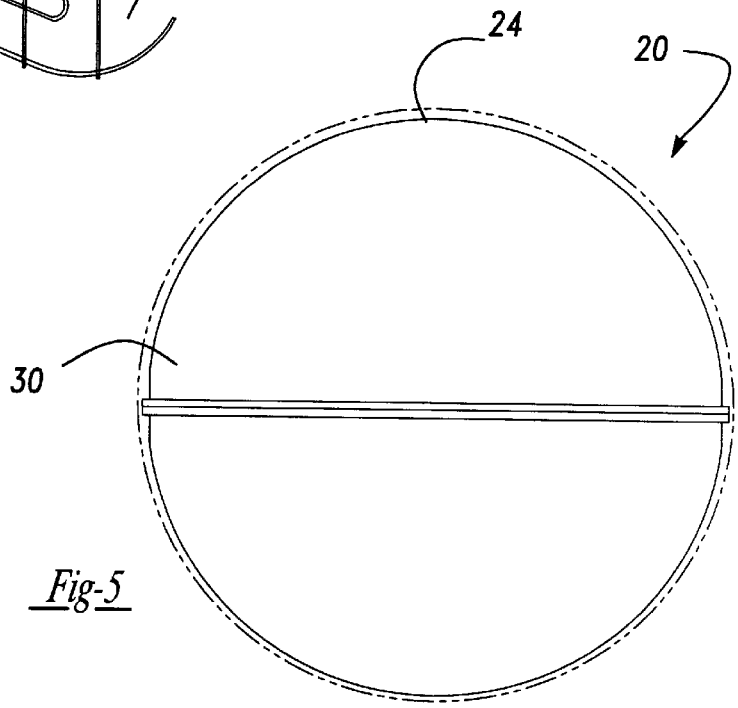
FIG. 5 is an end view of the inner packaging portion of the present invention.
Figure 4:
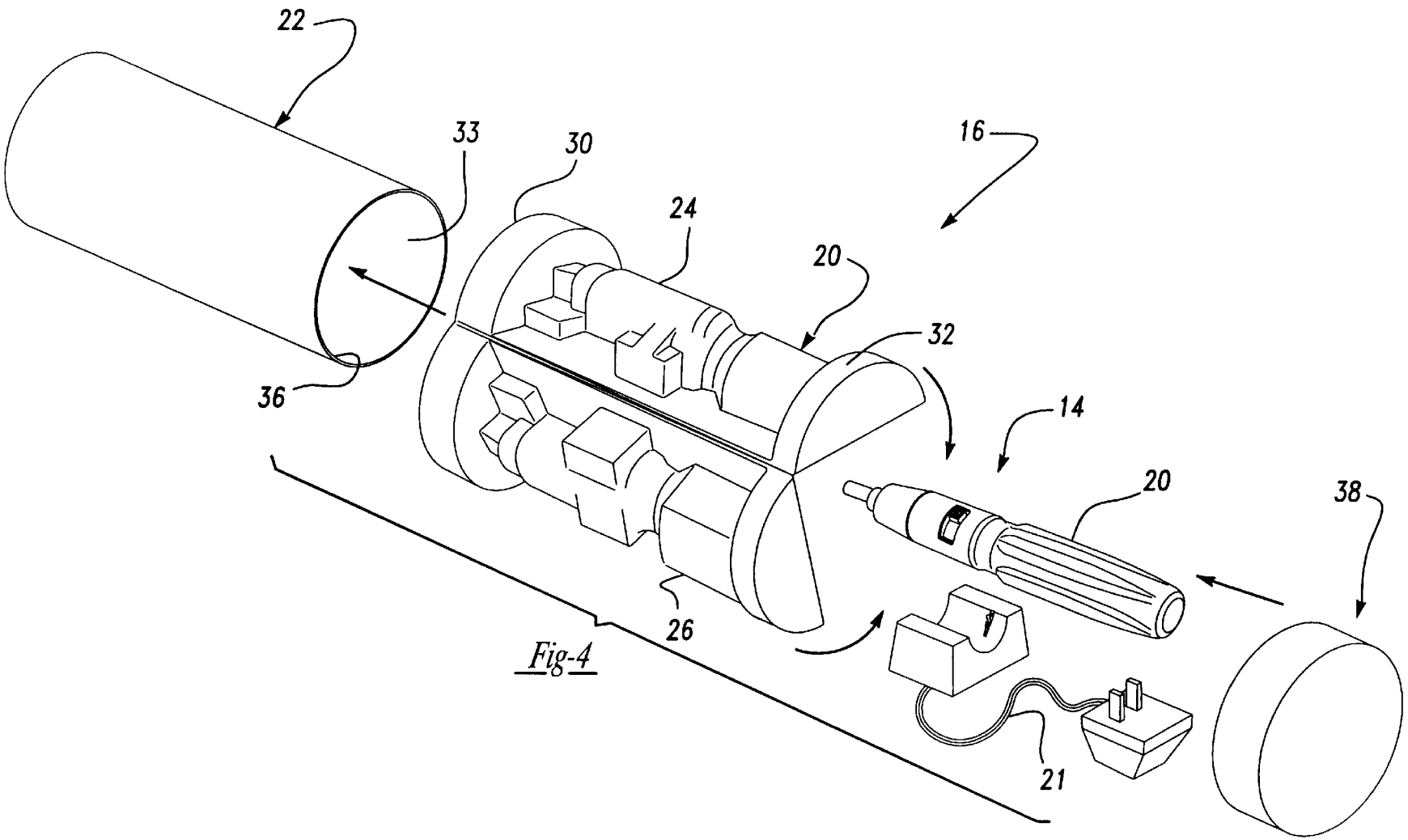
FIG. 4 is a exploded view of the retail unit of FIG. 4.
Figure 6:
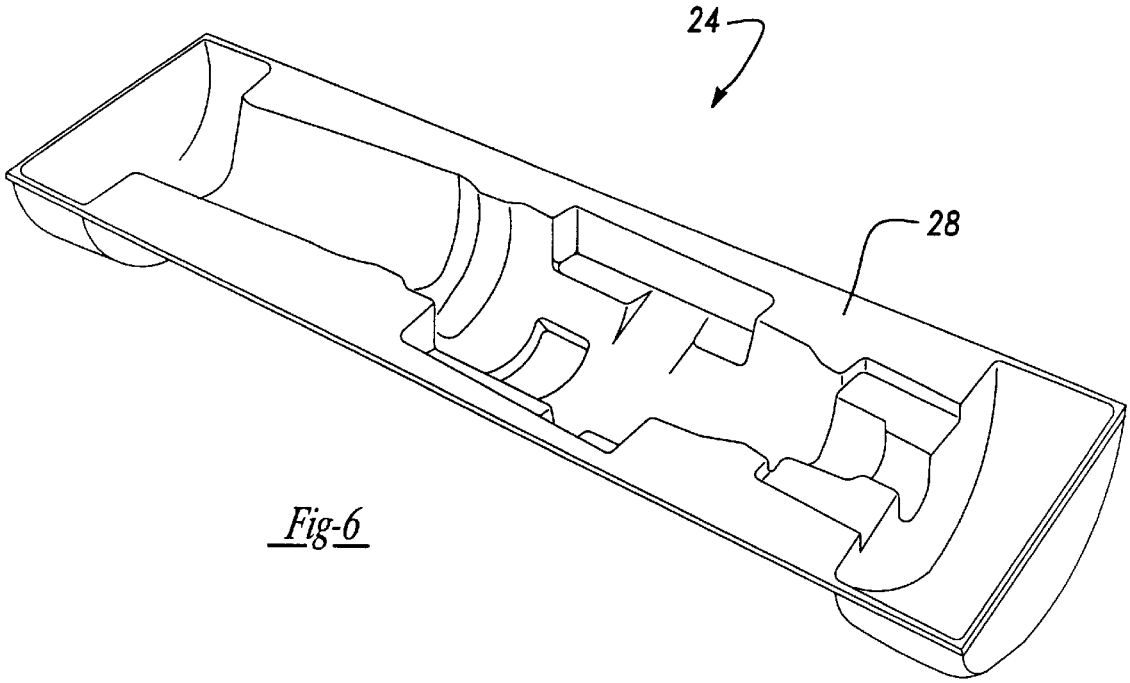
FIG. 6 is a perspective view of one of the halves of the inner packaging portion of FIG. 5.

The dispensing assembly 18 of the present invention will be described in further detail with particular reference to FIGS. 1 and 2. The dispensing assembly 18 includes a frame constructed of metal wires or rods 40. The metal rods 40 are welded or otherwise suitably joined. The metal rods 40 are configured to define a continuous stocking path 42 having a first end 44 and a second end 46. In the embodiment illustrated, the first end is an upper end 44 and the second end is a lower end 46. Preferably, the continuous stocking path 42 has a serpentine shape.

In the exemplary embodiment illustrated, the dispensing assembly 18 includes a pair of lateral sides both of which are formed of three serpentine shaped rods 40. The serpentine shaped rods are connected by five vertically extending rods 40. The lateral sides are interconnected by laterally extending rods 40. The laterally extending rods 40 interconnect a front one of the three serpentine shaped rods 40 of each of the laterally spaced sides at various points along their lengths. The laterally extending rods also interconnect a rear one of the three serpentine shaped rods 40 of each of the lateral sides.

In use, retail units 16 are inserted into the upper end 44 of the continuous stocking path 42. Under the force of gravity, the retail units 16 roll down the continuous stocking path 42 about their longitudinal axes until a first one of the retail units 16 encounters the second end 46 of the continuous stocking path 42. The metal rods 40 of the frame are configured to upwardly extend adjacent the lower opening 46 and thereby retain the first of the retail units 16. Additional retail units 16 are inserted into the upper end 44 of the continuous stocking path in a like manner until the continuous stocking path 42 is full. When the lowermost retail unit 16 is removed from the dispensing assembly 18, the remaining retail units 16 translate downward along the continuous stocking path 42.

In the exemplary arrangement illustrated in FIG. 1, twenty-two (22) retail units 16 are shown stocked within the continuous stocking path 42. As a result, retail merchandise is continuously present at the lower end 46 of the continuous stocking path where it is may be conveniently accessed by the retail customers. Restocking of the display assembly 18 is not necessary until the entire supply of retail units 16 is exhausted. Furthermore, the display assembly 18 does not require any product organization during a sell period. The display assembly 18 may be loaded with product prior to shipment to a retail store so that the display assembly 18 may be simply unboxed and suspended in a known manner, thereby minimizing setup time.

Thus, the present invention will now be understood to provide a package assembly 12 which converts the outermost perimeter of an irregularly shaped article 14 into a cylinder. The irregularly shaped article 14 can then be dispensed from the continuous stocking path.

While the present invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. A package assembly for an irregularly shaped article, the package assembly comprising:

an outer packaging portion defining a generally cylindrical cavity; and an inner packaging portion disposed within said cylindrical cavity, said inner packaging portion defining a cavity adapted for receiving the irregularly shaped article, said inner packaging portion including first and second halves and at least one generally cylindrical portion matingly received within said outer packaging portion.

2. The package assembly for an irregularly shaped article of claim 1, wherein said inner packaging portion includes a first end and a longitudinal axis, said first end having a circular outer diameter in a first plane perpendicular to said longitudinal axis.

3. The package assembly for an irregularly shaped article of claim 2, wherein said inner packaging portion includes a second end having a circular outer diameter in a second plane perpendicular to said longitudinal axis.

4. The package assembly for an irregularly shaped article of claim 1, wherein said outer packaging portion includes a hollow, cylindrical member defining said cylindrical cavity.

5. The package assembly for an irregularly shaped article of claim 1, in combination with the irregularly shaped article.

6. A system for dispensing an irregularly shaped article for retail sale in combination with the irregularly shaped article, the system comprising:

a plurality of package assemblies; and a dispensing assembly for dispensing said plurality of package assemblies, said dispensing assembly defining a continuous stocking path having an upper loading end for receiving said plurality of package assemblies and a lower end for dispensing said plurality of package assemblies, said continuous stocking path configured to transfer said plurality of package assemblies from said upper end to said lower end by gravity;

each package assembly of said plurality of package assemblies including an outer packaging portion and an inner packaging portion, said outer packaging portion defining a cylindrical cavity.

7. The system for dispensing an irregularly shaped article for retail sale of claim 6, wherein said inner packaging portion includes a first end and a longitudinal axis, said first end having a circular outer diameter in a first plane perpendicular to said longitudinal axis.

8. The system for dispensing an irregularly shaped article for retail sale of claim 7, wherein said inner packaging portion includes a second end having a circular outer diameter in a second plane perpendicular to said longitudinal axis.

9. The system for dispensing an irregularly shaped article for retail sale of claim 6, wherein said inner packaging portion includes first and second halves.

10. The system for dispensing an irregularly shaped article for retail sale of claim 6, wherein said outer packaging portion includes a hollow, cylindrical member defining said cylindrical cavity.

11. The system for dispensing an irregularly shaped article for retail sale of claim 6, wherein each said package assembly has a longitudinal axis, said longitudinal axes being aligned parallel to one another when said plurality of package assemblies are in said continuous stocking path.

12. The system for dispensing an irregularly shaped article for retail sale of claim 11, wherein said continuous stocking path has a serpentine shape in a plane perpendicular to said longitudinal axes.

13. The system for dispensing an irregularly shaped article for retail sale of claim 6, wherein said inner packaging portion disposed within said cylindrical cavity, said inner packaging portion defining a cavity adapted to receive the irregularly shaped article, said inner packaging portion including at least one cylindrical portion matingly received within said outer packaging portion.

14. A method for dispensing a plurality of irregularly shaped articles for retail sale, the method comprising:

providing a corresponding plurality of package assemblies each including an inner packaging portion defining a cavity and an outer packaging portion having a cylindrical member defining a cylindrical cavity;

receiving each of the irregularly shaped articles within said cavity of said inner packaging portion of a corresponding one of said plurality of package assemblies;

disposing each inner packaging of said plurality of package assemblies in a corresponding outer packaging portion to create a plurality of retail units each having a longitudinal axis and a constant, circular outer diameter;

providing a dispensing assembly defining a continuous stocking path having a first end for receiving said plurality of retail units and a second end for dispensing said plurality of retail units; and placing said plurality of retail units in said continuous stocking path.

15. The method for dispensing an irregularly shaped article for retail sale of claim 14, further comprising the step of:

moving said plurality of retail units from said first end to said second end by gravity.

16. The method for dispensing an irregularly shaped article for retail sale of claim 14, wherein said continuous stocking path has a serpentine shape in a plane perpendicular to the longitudinal axes of said retail units.

17. The method for dispensing an irregularly shaped article for retail sale of claim 14, wherein said inner packaging portion includes first and second halves.

* * * * *